US007662305B2

(12) United States Patent
Massaro et al.

(10) Patent No.: US 7,662,305 B2
(45) Date of Patent: Feb. 16, 2010

(54) MERCURY DISPENSING COMPOSITIONS AND DEVICE USING THE SAME

(75) Inventors: Vincenzo Massaro, Albairate (IT); Stefano Paolo Giorgi, Biassono (IT); Magda Bovisio, Milan (IT); Claudio Boffito, Nerviano (IT); Alessio Corazza, Como (IT)

(73) Assignee: Saes Getters S.p.A., Lainate MI (IT)

( * ) Notice: Subject to any disclaimer, the term of this patent is extended or adjusted under 35 U.S.C. 154(b) by 218 days.

(21) Appl. No.: 11/813,008

(22) PCT Filed: Jan. 5, 2006

(86) PCT No.: PCT/IT2006/000002

§ 371 (c)(1),
(2), (4) Date: Jun. 28, 2007

(87) PCT Pub. No.: WO2006/075347

PCT Pub. Date: Jul. 20, 2006

(65) Prior Publication Data

US 2009/0032767 A1 Feb. 5, 2009

(30) Foreign Application Priority Data

Jan. 17, 2005 (IT) ..... MI2005A0044

(51) Int. Cl.
*H01J 7/18* (2006.01)
*C22B 1/06* (2006.01)

(52) U.S. Cl. ..... 252/181.6; 252/181.2; 252/181.3; 75/327; 75/313

(58) Field of Classification Search ..... 252/181.2, 252/181.3, 181.6; 75/138; 149/19.3; 420/532
See application file for complete search history.

(56) References Cited

U.S. PATENT DOCUMENTS

| | | | | |
|---|---|---|---|---|
| 3,203,901 A | | 8/1965 | Della Porta | |
| 3,257,199 A | * | 6/1966 | Schmidt | 75/388 |
| 3,343,948 A | * | 9/1967 | Raclot | 420/532 |
| 3,544,829 A | | 12/1970 | Someya et al. | |
| 3,657,589 A | * | 4/1972 | Della Porta et al. | 313/556 |

(Continued)

FOREIGN PATENT DOCUMENTS

DE 19528390 A1 2/1997

(Continued)

OTHER PUBLICATIONS

Zhao et al Dept of Energy Report DE FC22-0029.*

(Continued)

*Primary Examiner*—James Seidleck
*Assistant Examiner*—Aaron Greso
(74) *Attorney, Agent, or Firm*—Panitch Schwarze Belisario & Nadel LLP

(57) ABSTRACT

Compositions for mercury dispensing in lamps are disclosed, comprising a first component comprising mercury and at least a metal selected between titanium and zirconium and a second component consisting of aluminum or either a compound or an alloy including at least 40% by weight of aluminum, wherein the weight ratio between the first and the second component is equal to or lower than 9:1; optionally, the compositions may also include a third component, selected among metals or oxides capable of reacting exothermically with aluminum.

30 Claims, 4 Drawing Sheets

U.S. PATENT DOCUMENTS

| | | | | | |
|---|---|---|---|---|---|
| 3,663,121 | A | | 5/1972 | Della Porta et al. | |
| 4,097,315 | A | * | 6/1978 | Gardner et al. | 149/2 |
| 4,464,133 | A | | 8/1984 | Buhrer | |
| 4,654,093 | A | * | 3/1987 | Bolinder et al. | 149/3 |
| 5,520,560 | A | | 5/1996 | Schiabel et al. | |
| 5,830,026 | A | | 11/1998 | Schiabel et al. | |
| 5,876,205 | A | | 3/1999 | Schiabel et al. | |
| 5,916,479 | A | * | 6/1999 | Schiabel et al. | 252/181.3 |
| 6,099,375 | A | | 8/2000 | Della Porta | |
| 6,107,737 | A | * | 8/2000 | della Porta | 313/556 |
| 2005/0199323 | A1 | * | 9/2005 | Nielson et al. | 149/19.3 |

FOREIGN PATENT DOCUMENTS

| | | | | |
|---|---|---|---|---|
| EP | 1310574 | | * | 5/2003 |
| GB | 2056490 | | * | 3/1981 |
| GB | 2056490 | A | | 3/1981 |
| WO | 98/53479 | A | | 11/1998 |
| WO | 2006/008771 | A1 | | 1/2006 |

OTHER PUBLICATIONS

Mesh Micron Conversion Table, Industrial Supply Inc. 2002 http://www.fluideng.com/FE/mexhmicron.html.*

Oh et al. Bull. Korean Chem. Soc. 1999 vol. 20 No. 11 pp. 1340-1344.*

Valimet Inc H Alum_Powder_Specs[1] http://www.valimet.com/documents/aluminum.htm.*

* cited by examiner

MERCURY DISPENSING COMPOSITIONS AND DEVICE USING THE SAME

CROSS-REFERENCE TO RELATED APPLICATIONS

This application is a Section 371 of International Application No. PCT/IT2006/000002, filed Jan. 5, 2006, which was published in the English language on Jul. 20, 2006, under International Publication No. WO2006/075347 A2, the disclosure of which is incorporated herein by reference.

BACKGROUND OF THE INVENTION

The present invention relates to mercury dispensing compositions.

The compositions of the invention are particularly suitable for the use in dosing mercury inside fluorescent lamps.

As known, fluorescent lamps require for their operation a gaseous mixture at pressures of some hundreds of hectoPascal (hPa), formed by noble gases and mercury vapors. In the past mercury was introduced into the lamps in liquid form, either by direct dripping into the lamp, or inside of small glass vials which afterwards were opened inside the lamp. However, due to the toxicity of mercury, the most recent international regulations have imposed the use of the lowest possible quantity of the element, compatibly with the lamps functionality; this has rendered the liquid dosage methods obsolete, because these are not capable of dosing in lamps quantities of mercury of few milligrams or even smaller than one milligram.

Another method for the introduction of mercury into lamps is by means of metal amalgams. However, this method implies a problem: some manufacturing steps of the lamps are carried out at relatively high temperatures, generally higher than 400° C., when the lamp is not sealed yet, while the mercury release from these materials starts already at low temperatures, between about 100 and 300° C. depending on the metal with which mercury is amalgamated; in these conditions emissions of mercury, which is a harmful metal for health, occur into the working environment.

In order to overcome these problems, it was proposed in the past the use of various solid products which allow to overcome or at least reduce the problems seen before.

U.S. Pat. No. 3,657,589 in the Applicant's name discloses $Ti_xZr_yHg_z$ compounds, which do not release mercury when heated up to about 500° C., but can release it when heated to about 800-900° C. (so-called activation treatment); the preferred compound of this family is $Ti_3Hg$, sold under the trade name St 505. These compounds have the advantage that they can be powdered and dosed into small weight quantities for producing mercury dispensing devices containing the required amount of this metal. A problem of these compounds is, however, that they undergo a partial oxidation during the lamp manufacturing steps, whereby the amount of mercury released during activation is only about 40% of the total mercury content, which forces to introduce into the lamp a quantity of mercury noticeably larger than necessary, with disposal problems at the end of the life of the lamps.

British patent application GB-A-2,056,490 discloses Ti—Cu—Hg compositions having better properties of mercury release compared to those of the compounds of U.S. Pat. No. 3,657,589. In particular, these compounds are stable in air up to about 500° C., while by heating up to 800-900° C. they release quantities of mercury higher than 80%, or even than 90%.

The U.S. Pat. No. 5,520,560, U.S. Pat. No. 5,830,026 and U.S. Pat. No. 5,876,205 disclose combinations of powders of the compound St 505 with a promoter of the mercury yield (respectively, copper-tin alloys with possible additions of small quantities of other transition elements; copper-silicon alloys; and copper-tin-Rare Earths alloys); the addition of the promoter allows to increase the mercury yield from the compound St 505 up to values of 80-90%, even after its oxidation, thus avoiding the need of using a large excess of mercury as happens with the compound St 505 used alone.

Finally, U.S. Pat. No. 4,464,133 proposes to use mixtures of powders of the compound $Ti_3Hg$ with an element selected between nickel or copper; according to what is stated in this document, by these mixtures it is possible to achieve the mercury release already at the temperature of 770° C.

The releasing of mercury from these mixtures and compositions is normally obtained by heating by means of radiofrequencies, by positioning an induction coil externally to the lamp in a position close to the device which comprises the mercury containing material; good yields of the metal are achieved by heating treatments of total duration of about 20-30 seconds per lamp.

However, the properties of mercury releasing from known compositions and mixtures, although good, are not yet completely satisfactory for lamp manufacturers. An optimal mercury dispenser for lamp manufacturing should have the following features:

- zero metal emissions up to at least 500° C., and possibly up to about 600° C., for being used also in the manufacturing of circular lamps, wherein some operations require higher temperatures than in the case of linear lamps;
- total or almost total yield of mercury so that, for the same quantity of mercury released in the lamp, the initial amount of mercury present in the device is the lowest possible, to comply with international regulations on the use of harmful materials in industrial manufacturing;
- an activation temperature lower than those used hitherto, to reduce the energy consumption in the manufacturing line (the induction coils have to be provided with a lower power);
- shorter activation times with respect to those required by the compositions used hitherto, to increase productivity.

BRIEF SUMMARY OF THE INVENTION

Object of the present invention is to provide mercury dispensing compositions which satisfy the above requirements of lamp manufacturers.

This and other objects are obtained according to the present invention by means of compositions comprising:

- first component, A, being a compound comprising mercury and at least a metal selected between titanium and zirconium; and
- second component, B, consisting of aluminum or either a compound or an alloy containing at least 40% by weight of aluminum and having melting temperature equal or lower than that of this element, wherein component A may be present in weight percentage equal or lower than 90%.

Further, the compositions of the invention may optionally comprise a third component, C, selected among metals or compounds able to react exothermically with aluminum. The possible compositions in the case of this third component being present are reported below.

In the remainder of the description all percentages regarding the composition of the components A, B and C, as well as their ratios, are to be intended by weight unless otherwise indicated.

The inventors have found that the compositions of the invention (with two or three components) are able, if heated to 650° C., to give rise to an exothermic reaction which causes a localized temperature increase of some hundreds of degrees Celsius in few seconds; it is thus caused the practically complete emission of mercury from the compound containing the same, even with a heating from outside of duration reduced with respect to the processes presently in use.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

The component A of the compositions of the invention is a compound comprising mercury, at least one element selected between titanium and zirconium, and optionally also copper or a combination of copper and tin. Components A suitable for the purposes of the present invention are the Ti—Hg compounds (and particularly the $Ti_3Hg$ compound) disclosed in the U.S. Pat. No. 3,657,589; the Ti—Cu—Hg compounds disclosed in the British patent application GB-A-2,056,490; and the Ti—Cu—Sn—Hg compounds disclosed in international patent application PCT/IT2005/000389.

The component B of the compositions of the invention can be aluminum; as an alternative it is possible to use a compound or alloy which contains at least 40% by weight of aluminum and has a melting temperature not higher than that of aluminum. For the objects of the invention the alloys Al—Cu have proved to be suitable, in particular those with composition close to the eutectic Al 68%-Cu 32%, the intermetallic compound with composition Al 46.6%-Cu 53.4% or the Al—Cu alloys with composition proximate thereto; further, the Al—Si alloys are suitable, for example with composition corresponding or proximate to the eutectic Al 87.3%-Cu 12.7%, and the Al—Cu—Sn alloys.

Finally, the optional component C of the compositions of the invention is a metal or a compound (generally an oxide) able to react exothermically with aluminum. This third component can be selected among the transition metals, in particular Ni, Fe, Y, Ti and Zr, Rare Earths, or some oxides such as iron oxide, $Fe_2O_3$, copper oxide, CuO, or manganese oxide, $MnO_2$.

In case of compositions with two components (A and B), the weight of the component A can reach 90% of the total weight of the composition. In compositions even richer in component A, the amount of component B is excessively reduced and the increase in temperature due to the exothermic reaction is not sufficient to cause a complete releasing of the mercury contained in A.

Figure 1:
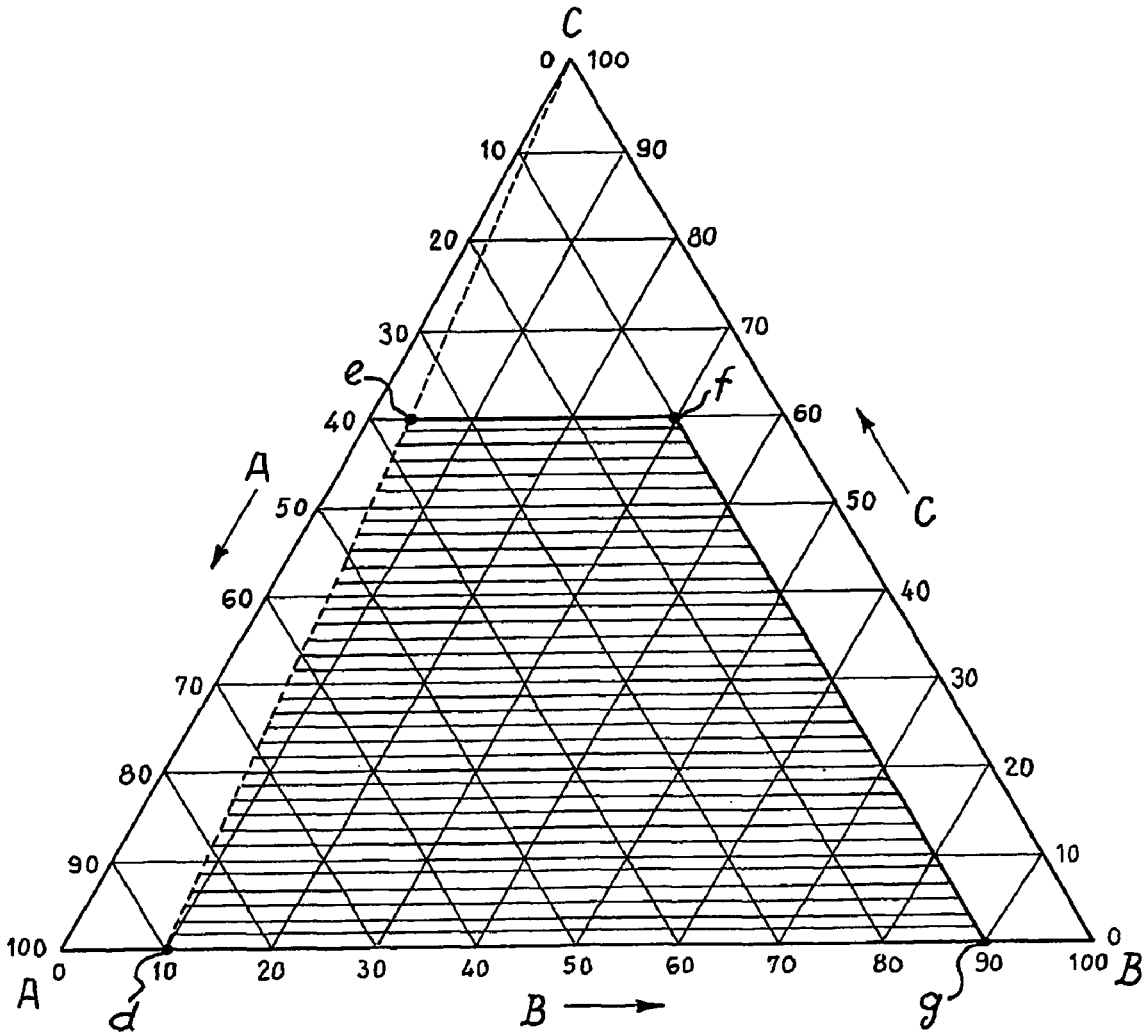
FIG. 1 is a ternary diagram wherein the range of the possible compositions according to the invention is illustrated, by weight percentage.

The condition that the component A is present up to 90% by weight in the compositions of two components can be expressed also by stating that the weight ratio between A and B can be equal or lower than 9:1 (A:B≦9:1). This condition, expressed in this second way, holds as well, for the same reason stated above, also in case of compositions containing also the third component C. FIG. 1 shows a ternary diagram (percentages by weight) of the possible compositions A—B—C. The binary composition A—B corresponding to the maximum content of A is the point d in the drawing; in this figure, the range of compositions wherein A:B≦9:1 is represented by all compositions on the right hand of the broken line which links point d to the vertex representing component C.

Even if all compositions on the right hand of the segment d-C in FIG. 1 show the effect of rapid and complete release of mercury contained in the component A, the compositions which fall in some parts of the thus defined area turn out to have scarce practical utility; for instance, compositions wherein the component A is present for less than 10% by weight are hardly useful because, in order to have a desired amount of mercury in the lamp, these would require to use devices of uselessly large weight and dimensions; there would be similar problems with compositions wherein the amount of component C is more than 60% by weight.

The range of preferred compositions is thus delimited by points d-e-f-g in FIG. 1 (cross-hatched area), which correspond to the percentage compositions by weight:

d) A 90%-B 10%-C 0% e) A 36%-B 4%-C 60% f) A 10%-B 30%-C 60% g) A 10%-B 90%-C 0%

In case component C is an oxide, because of the high exothermicity of the reaction of aluminum with oxygen, it is sufficient and preferable to use small quantities of the component C, for example smaller than 20% by weight and even more preferably smaller than 5% by weight.

The two (or three) components of the compositions of the invention can be used in different physical forms. In the case of components which are elemental metals (as the aluminum used as component B, or a metal used as component C), it is possible to use these components in the shape of strips or parts formed with other configurations, to which the component A is brought into contact or is adhered thereon; for example, the composition of the invention in a similar case could consist of powders of component A rolled on an aluminum sheet of sufficient thickness or contained in an aluminum tube (component B); or further, it is possible to roll powders of the components A and B (in this case B is preferably an aluminum alloy, having a hardness sufficient for rolling) on a strip of a metal as iron or nickel.

However, all components are preferably used in form of powders, of particle size generally smaller than 500 μm, preferably smaller than 250 μm, and more preferably smaller than 125 μm.

As known in the field, in the lamps it is generally necessary to use also a getter material for sorbing traces of gases potentially detrimental to their functioning, such as oxygen, hydrogen or water; an example of getter material widely used in the field is the alloy having composition Zr 84%-Al 16% disclosed in the U.S. Pat. No. 3,203,901.

Using powders having the compositions of the invention, mercury dispensing devices of various shapes can be manufactured, some examples thereof being represented in FIGS. 2 through 6; in these devices it is possible to add optional getter materials, for example mixed in form of powders with the composition of the invention, or added separately in the devices.

Figure 2:
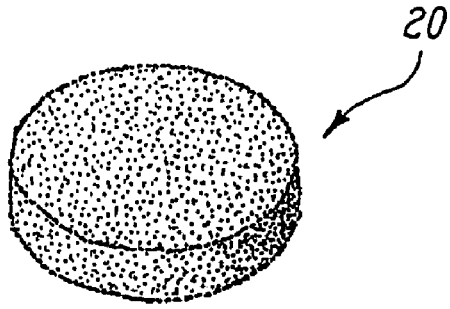
FIGS. 2 through 6 show some possible shapes of mercury dispensing devices that can be manufactured by using the compositions of the invention.
Figure 3:
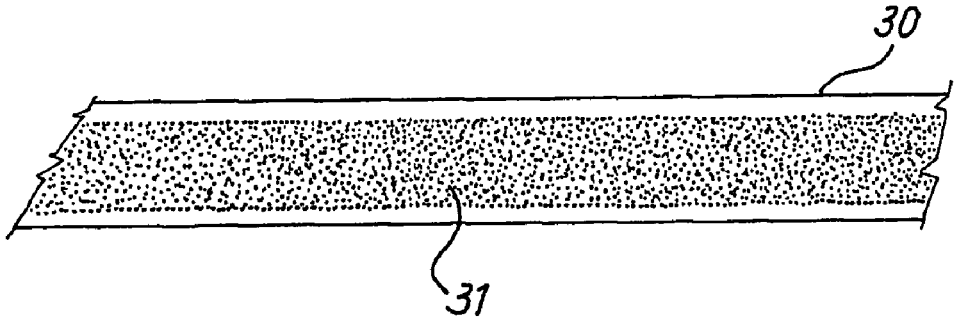
Figure 4:
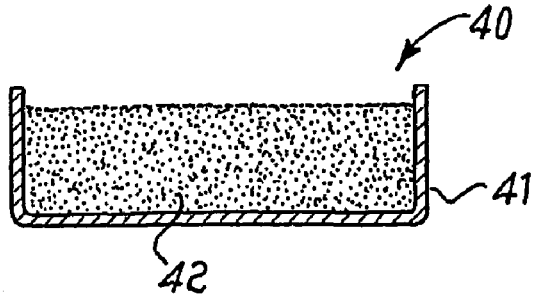
Figure 5:
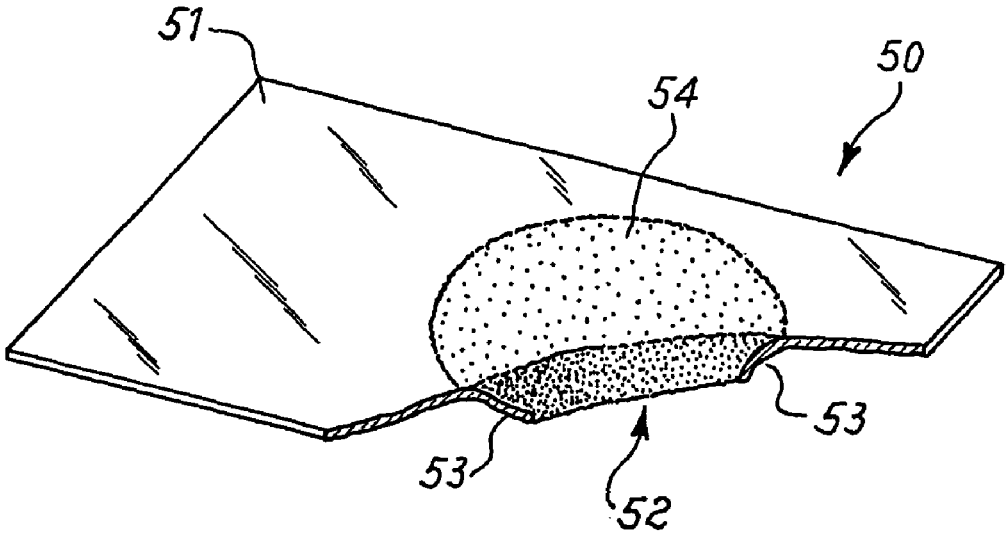
Figure 6:
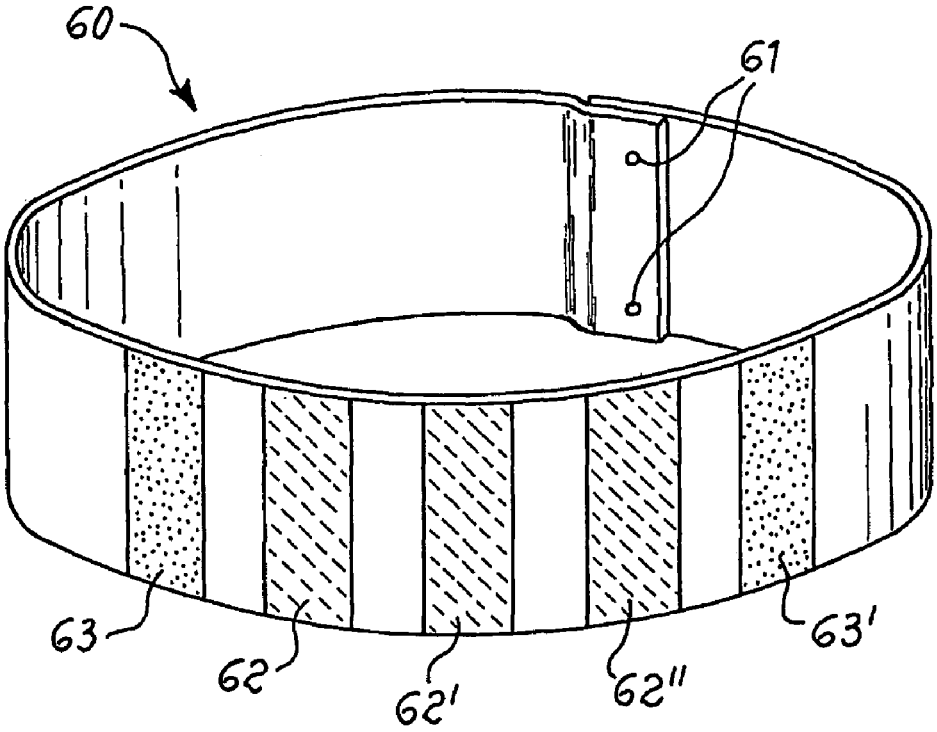

FIG. 2 shows a mercury dispenser merely consisting of a pellet 20 of compressed powders having a composition according to the invention. FIG. 3 shows a metallic strip 30 coated with powders 31 having a composition according to the invention; from the strip it is possible to obtain, by cutting, discrete devices (not shown in the drawing) for mercury releasing. FIG. 4 shows in cross section a device 40 consisting of a container 41 wherein a composition of the invention, 42, is present. FIG. 5 shows a broken apart view of another possible device geometry, frequently adopted in the lamp industry mainly for getter devices (that is, the devices present in almost every lamp for sorbing the harmful gases present therein); in this case the device, 50, is formed by a metallic strap 51, which has a hole 52, the edge 53 of which is depressed with respect to the plane of the strap; in the so shaped cavity there is manufactured a pellet of compressed powders of a composition of the invention, 54; the presence of the hole exposes also the back surface of the pellet, so as to increase the surface of exposed powder and maximize the mercury release; the farthest part of the device 50 from the hole 52 is used for fixing to a support inside the lamp. Finally, FIG. 6 shows a device which integrates the functions of shielding the electrodes, gettering, and mercury releasing, according to the teaching of the U.S. Pat. No. 6,099,375; the device 60 is obtained by closing as a ring (for example by welding spots 61) a piece of a strip similar to that in FIG. 3, whereon are however present tracks of many materials; in the example in figure three tracks 62, 62' and 62" having a composition according to the invention and two tracks 63 and 63' of getter material are shown.

For obtaining devices of the type illustrated in FIGS. 2, 4 and 5, it can be preferable to use aluminum as component B, which because of its plasticity deforms during compression and favors the mechanical stability of the powder packets that are present in these devices; vice versa, in the case of devices of the type shown in FIGS. 3 and 6, which are normally manufactured by cold-rolling, it is preferable to use as component B an aluminum alloy, because the higher hardness of the alloys with respect to pure metal favors the anchoring of the powders to the metallic strip during rolling.

By the compositions of the invention it is possible to obtain easily devices with a low, but precise and reproducible, dosage of mercury in a lamp. In devices of the type of FIGS. 2, 4 and 6 it is possible to use compositions having a low content of component A (for example, compositions close to the segment f-g in FIG. 1), thus decreasing the amount of mercury while dimensions and weight of the device are the same; by the devices of FIGS. 3 and 6, in addition to operate on the composition, it is also possible to control the width of the tracks of the different materials, thus controlling the charging of mercury per unit of length of the metallic strip.

The invention will be further illustrated by the following examples. These non-limiting examples illustrate some embodiments intended to teach those skilled in the art how to put in practice the invention and to show the best mode for performing the invention.

Example 1

In this example it is verified the temperature variation of a pellet manufactured with a composition of the invention, during heating by radio frequencies.

Figure 7:
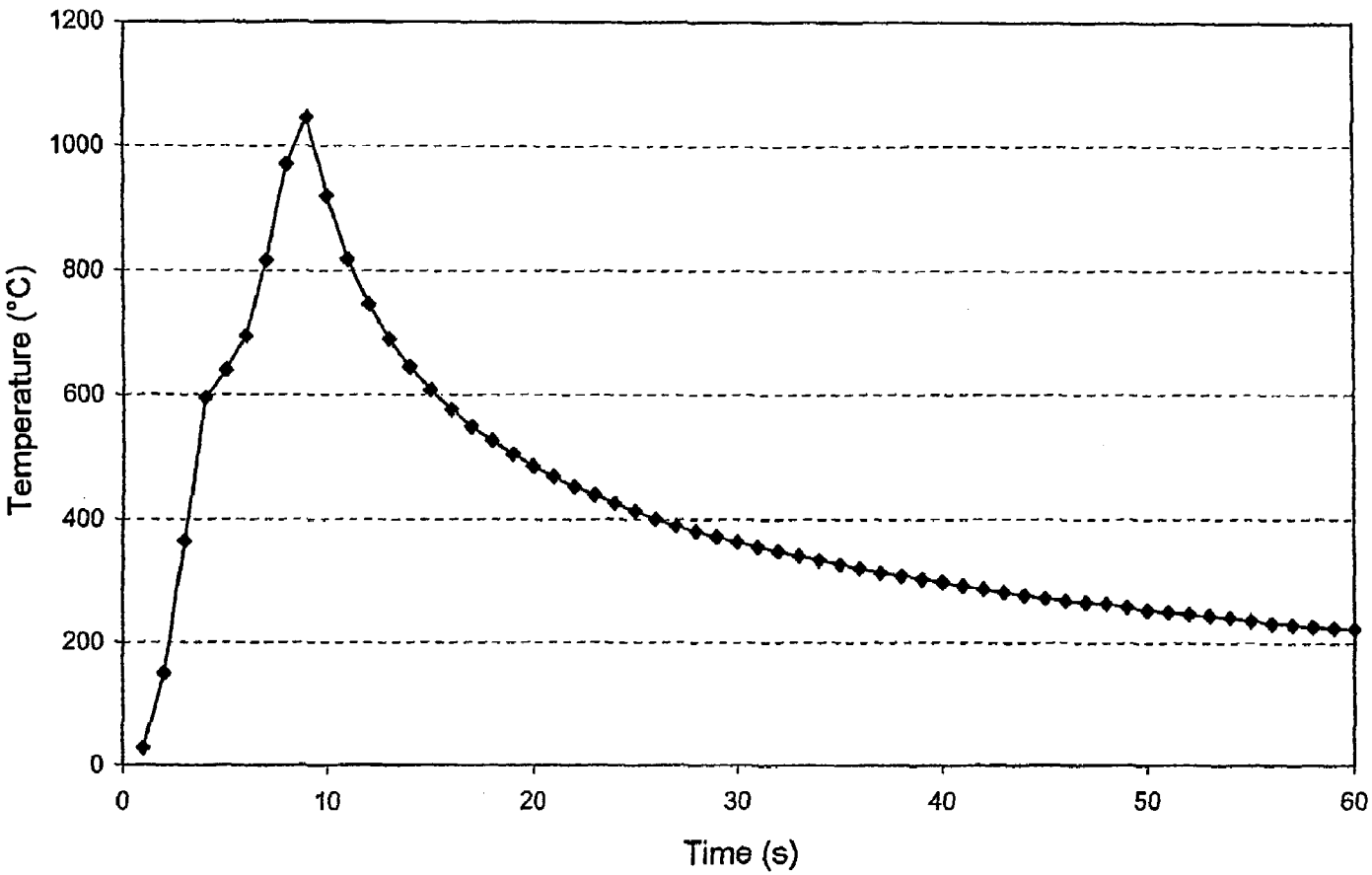
FIG. 7 shows a curve which illustrates the temperature increase of a composition of the invention when heated.

A composition of the invention consisting of 24 milligrams (mg) of powder of $Ti_3Hg$ compound and 16 mg of aluminum powder is prepared; both powders have particle size smaller than 128 μm. The mixture of powders is compressed in a suitable cylindrical mold with a pressure of 1,400 $Kg/cm^2$, thus obtaining a pellet having diameter of 4 mm and thickness of about 1 mm. This pellet is introduced in a glass flask which is then evacuated. The pellet is then heated from outside by means of radio frequencies, and with an optical pyrometer the temperature of the pellet during the test is measured. The temperature variation is shown in FIG. 7 as temperature (° C.) as a function of time (seconds, s). As shown in the drawing, when 650° C. are reached an abrupt increase in temperature occurs, which can only be caused by a triggering of an exothermic reaction in the system; immediately after the beginning of this increase in temperature, evaporation of mercury takes place, observed through the formation of droplets of liquid mercury in cold spots of the glass wall of the flask; owing to the exothermic reaction the temperature exceeds 1,000° C. in about 3 seconds, and keeps higher than the triggering temperature for about further 8 seconds.

Example 2

In this example the mercury emission properties of various samples of compositions of the invention are measured.

Nine pellets having diameter equal to 4 mm and variable weight and height are manufactured as described in example 1, using different mixtures of components A, B and C; as component A the $Ti_3Hg$ compound is again used; as component B aluminum is again used; the compositions of the different pellets are given in Table 1, wherein the component C used in tests 8 and 9 (the only ones comprising such component) is also indicated. These pellets are introduced one at a time in a glass flask and the evaporation of mercury as described in example 1 is caused. At the end of each test, after cooling the system, the pellet is withdrawn from the flask and dissolved in a solution containing a mixture of nitric and sulfuric acids, bringing mercury into solution as ion $Hg^{2+}$; this is then reduced to metallic mercury with sodium-boron hydride ($NaBH_4$), and the vapors of the metal are sent to an Atomic Absorption Spectrophotometer, measuring the concentration of mercury in solution; from this datum it can be deduced the amount of residual mercury in the pellet after the test and, as difference between the amount of mercury initially present in the pellet (known from the amount of component A and from the chemical composition thereof) and the residual value so measured, the amount of evaporated mercury is obtained. In Table 1 the weight of each pellet, of the single components thereof, the (calculated) total amount of mercury contained in each pellet at the beginning of the test, the maximum temperature reached in each test, the amount of mercury released and the yield of mercury (percentage of mercury released with respect to the total) are reported. In all tests triggering temperatures comprised between 650° C. and 660° C. are observed.

The features of the compositions of the invention allow to heat from outside the pellet for times comprised only between about 3 and 5 seconds, while with a composition of the prior art, wherein the release of mercury starts at about 800° C., times of heating of at least 6 seconds and generally of about 10 seconds are necessary; further, as the complete release of mercury requires that the temperature is at the required values for about 10 seconds, with the compositions of the prior art it is necessary to heat from outside during all evaporation time, while with the compositions of the invention the temperature remains at high values, above 800° C., for several seconds without the need of heating from outside. This allows to have shorter times of heating from outside, and therefore to increase the hour productivity of the lamp manufacturing lines. Furthermore, all therefore to increase the hour productivity of the lamp manufacturing lines. Furthermore, all compositions of the invention show very high mercury release yields, all higher than 93% and in one case equal to 98.7%, therefore allowing to reduce the amount of unused mercury to minor values only.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

TABLE 1

| Test | Pellet weight (mg) | A (mg) | B (mg) | C (mg) | Hg init. (mg) | T max (° C.) | Hg evap. (mg) | Yield Hg (%) |
|---|---|---|---|---|---|---|---|---|
| 1 | 40.9 | 24.5 | 16.4 | / | 13.3 | 980 | 12.7 | 95.4 |
| 2 | 36.6 | 22.0 | 14.6 | / | 11.9 | 1045 | 11.2 | 94.5 |
| 3 | 31.6 | 19.0 | 12.6 | / | 10.2 | 1000 | 9.9 | 96.7 |
| 4 | 31.4 | 18.9 | 12.6 | / | 10.2 | 990 | 9.7 | 95.0 |
| 5 | 30.6 | 18.4 | 12.2 | / | 9.9 | 992 | 9.3 | 93.8 |
| 6 | 29.7 | 17.8 | 11.9 | / | 9.6 | 1018 | 9.5 | 98.7 |
| 7 | 28.0 | 16.8 | 11.2 | / | 9.1 | 1020 | 8.5 | 93.7 |
| 8 | 40.0 | 8.0 | 12.8 | 19.2 (Fe) | 4.3 | 1015 | 4.1 | 95.3 |
| 9 | 40.0 | 16.0 | 11.2 | 12.8 (Ni) | 8.7 | 1030 | 8.3 | 95.4 |

The invention claimed is:

1. Mercury dispensing compositions comprising:

a first component, A, being a compound consisting of mercury and at least one metal selected from the group consisting of titanium and zirconium; and a second component, B, consisting of aluminum or either a compound or an alloy containing at least 40% by weight of aluminum and having a melting temperature equal to or lower than that of aluminum, wherein component A is present in a weight percentage of 10% to 90% of the total weight of the composition.

2. The compositions according to claim 1, further comprising a third component, C, selected from the group consisting of metals and compounds capable of reacting exothermically with aluminum.

3. The compositions according to claim 1, wherein component A is the $Ti_3Hg$ compound.

4. The compositions according to claim 1, wherein component B is aluminum.

5. The compositions according to claim 1, wherein component B is an alloy of aluminum and copper.

6. The compositions according to claim 5, wherein said alloy has percentage composition by weight Al 68%-Cu 32%.

7. The compositions according to claim 1, wherein component B is the intermetallic compound having percentage composition by weight Al 46.6%-Cu 53.4%.

8. The compositions according to claim 1, wherein component B is an alloy of aluminum and silicon.

9. The compositions according to claim 8, wherein said alloy has percentage composition by weight Al 87.3%-Si 12.7%.

10. The compositions according to claim 1, wherein component B is an alloy of aluminum, copper and tin.

11. The compositions according to claim 2, wherein component C is a metal of transition or of the Rare Earths.

12. The compositions according to claim 11, wherein said metal is selected from the group consisting of Ni, Fe, Y, Ti and Zr.

13. The compositions according to claim 2, wherein component C is an oxide selected from the group consisting of iron oxide, $Fe_2O_3$, copper oxide, CuO, and manganese oxide, $MnO_2$.

14. The compositions according to claim 2, wherein the weight ratio between the components A and B is equal to or lower than 9:1.

15. The compositions according to claim 2 that, in a ternary diagram of weight percent composition, are comprised in a range delimited by the following points:

d) A90%-B 10%-C 0% e) A36%-B 4%-C 60% f) A10%-B 30%-C 60% g) A10%-B 90%-C 0%.

16. The compositions according to claim 15, wherein, when component C is an oxide, the weight percentage of this component is equal to or lower than 20%.

17. The compositions according to claim 16, wherein said percentage is lower than 5%.

18. A device for mercury dispensing comprising a composition according to claim 1, wherein component A is put in contact or is adhered on a metallic part produced with component B.

19. A device for mercury dispensing comprising a composition according to claim 2, wherein components A and B are put in contact or are adhered on a metallic part produced with component C.

20. The device according to claim 19, wherein said metallic part is in a form of strip.

21. The device according to claim 19, wherein said metallic part is in tubular form.

22. The device for dispensing mercury according to claim 19, wherein both the components A and B and the optional component C are present in a form of powders having particle size lower than 500 μm.

23. The device according to claim 22, wherein said powders have particle size lower than 250 μm.

24. The device according to claim 23, wherein said powders have particle size lower than 125 μm.

25. The device according to claim 22, wherein the device is formed by a pellet of compressed powders of a composition of the invention.

26. The device according to claim 22, wherein the device is obtained by cutting strips from a larger metallic strip coated with powders of a composition of the invention.

27. The device according to claim 22, wherein the device is formed by a container wherein is present a composition of the invention.

28. The device according to claim 22, consisting of a metallic strap which is provided with a hole the edge of which is depressed with respect to the plane of the strap, and a pellet of compressed powders of the composition of the invention in the cavity formed by said hole in said strap.

29. The device according to claim 22, further comprising powders of a getter material.

30. The device according to claim 29, wherein the device is obtained by closing as a ring a piece of a metallic strip whereon one or more tracks of a composition of the invention and one or more tracks of a getter material are present.

* * * * *